United States Patent [19]

Ferrando

[11] Patent Number: 4,625,909

[45] Date of Patent: Dec. 2, 1986

[54] COMPUTERIZED CORRESPONDENCE FORM

[76] Inventor: Franco Ferrando, via Repubblica, 39, 13051 Biella (Vercelli), Italy

[21] Appl. No.: 564,636

[22] Filed: Dec. 22, 1983

[30] Foreign Application Priority Data

Dec. 29, 1982 [IT] Italy ..... 68525 A/82

[51] Int. Cl.[4] ..... B65D 27/00; B65D 27/10

[52] U.S. Cl. ..... 229/92.1; 229/69

[58] Field of Search ..... 229/92.1, 92.3, 69

[56] References Cited

U.S. PATENT DOCUMENTS

| | | | |
|---|---|---|---|
| 2,451,233 | 10/1948 | Menocal | 229/92.1 |
| 2,881,971 | 4/1959 | Tolve | 229/92.1 |
| 2,985,464 | 5/1961 | McFarland | 229/92.3 |
| 3,124,300 | 3/1964 | Vonderscher | 229/92.1 |
| 3,902,655 | 9/1975 | Huffman | 229/92.1 |
| 3,941,307 | 3/1976 | Van Malderghem | 229/69 |
| 4,236,731 | 12/1980 | Hektoen | 229/69 |
| 4,239,114 | 12/1980 | Denay | 229/69 |
| 4,380,315 | 4/1983 | Steidinger | 229/69 |

*Primary Examiner*—Stephen P. Garbe

*Attorney, Agent, or Firm*—David A. Jackson

[57] ABSTRACT

Computerized correspondence form on which at least one part is designed to be folded so as to form an envelope and letter and consists of at least two sheets joined together along at least one side strip bordered inwards, on the envelope and letter, by respective preset tear lines of which the one on the envelope provides for greater weakening than the one on the letter; an adhesive strip being provided along each side edge on the back of the said part of the form.

11 Claims, 18 Drawing Figures

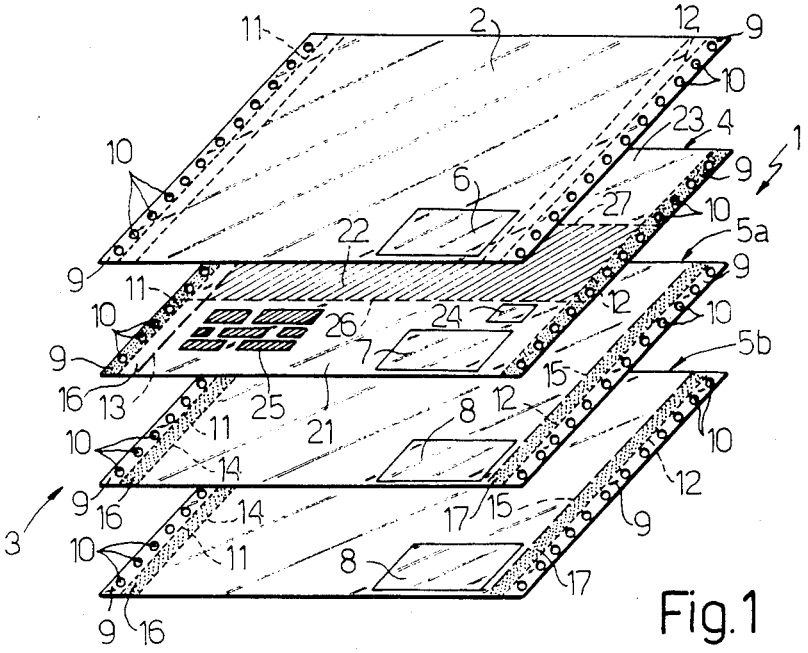
Fig.1
Fig.2
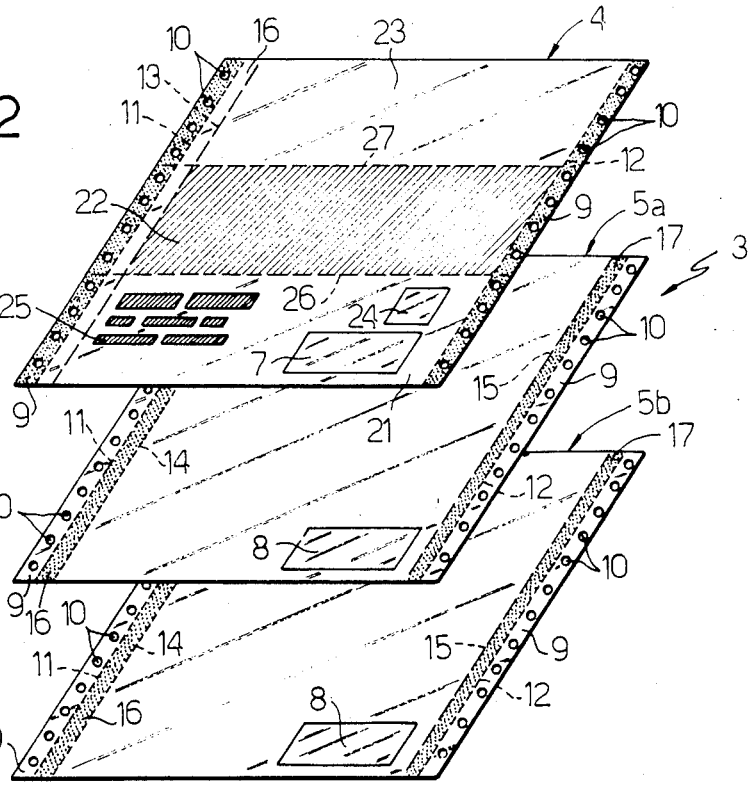

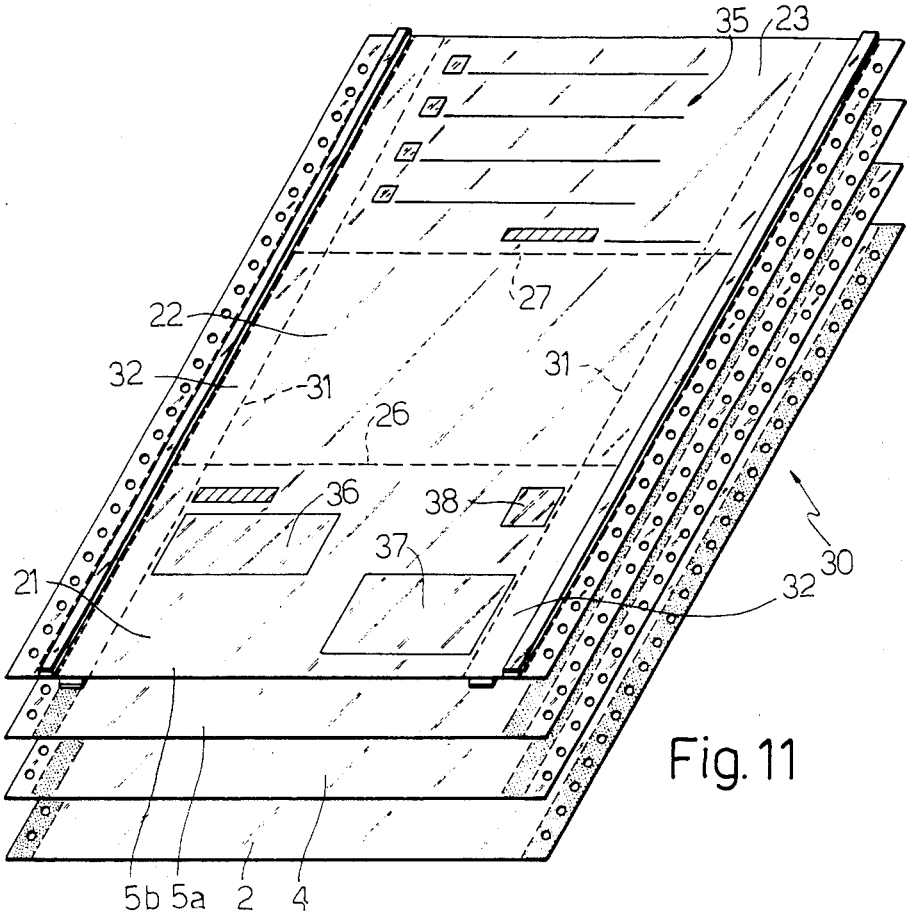
Fig. 11
Fig. 10
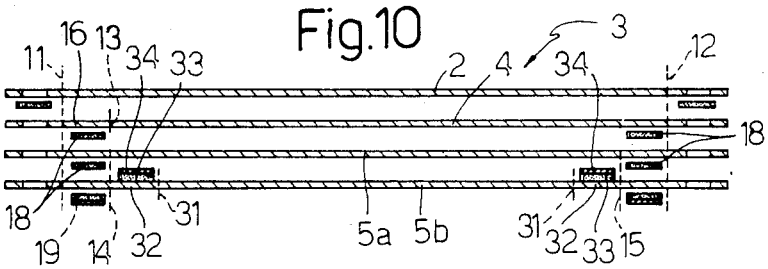
Fig. 13
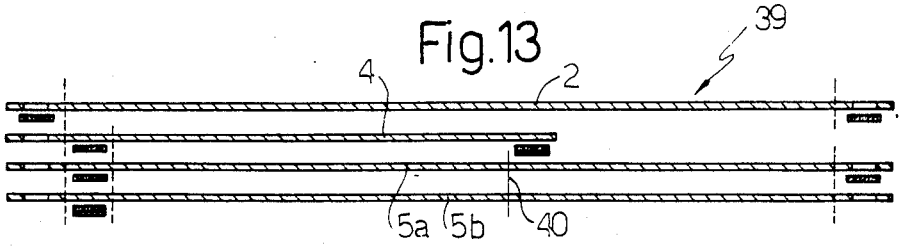

COMPUTERIZED CORRESPONDENCE FORM

BACKGROUND OF THE INVENTION

The present invention relates to a computerized correspondence form designed to be used either singly or in conjunction with others of the same type for forming a computer print-out sheet.

Up to now, known types of computerized correspondence forms are made using highly complex punched sheets usually comprising an envelope consisting of two sheets joined together. Usually, a side portion of the said envelope can be torn off along preset tear lines enabling the receiver to open the envelope by removing, together with the separate edge, a sheet of chemical or impressed paper inside.

The said envelope is usually joined to a further outside sheet or original copy which is kept by the sender. On the original sheet enclosed in the envelope, the printer on the computer usually prints the name and address of the receiver followed by the text of the letter. On the back of the space reserved for the receiver's name and address, the original sheet is provided with a carbon strip so as to enable the receiver's name and address to be printed on the envelope, whereas the text of the letter is printed straight on to the sheet of chemical paper inside the envelope which, after being stamped, is ready to be mailed.

As of present, large-scale circulation of the above so-called "pre-enclosed" computerized correspondence forms is limited by a number of factors.

The first and most important of these is the high cost of pre-enclosed forms which are only economically feasible if used in very large numbers.

A second and by no means less important factor restricting the circulation of pre-enclosed forms is the very limited space allowed for the sender to print the message. On a pre-enclosed form, in fact, most of the space available on the sheet inside the envelope is taken up by the sender's and receiver's name and address so that, if the envelope has to conform with the standard dimensions imposed by the Post Service for standard rate automatic mailing, only two or three lines at most are left on the sheet for printing the message.

SUMMARY OF THE INVENTION

The aim of the present invention is to provide a computerized correspondence form of extremely simple design which can be printed cheaply by any printing shop on a relatively small scale.

A further aim of the present invention is to provide a computerized correspondence form enabling a relatively long message to be printed in addition to the receiver's name and address.

With these aims in view, the present invention relates to a computerized correspondence form at least one portion of which is designed to be folded so as to form an envelope containing at least one sheet, characterised by the fact that the said portion of the form comprises a first sheet and at least a second sheet joined along at least a first of two side strips extending close to and parallel to a first and second side edge of the said part of the form; a preset tear line weakening each said sheet along an inner side edge of the said first strip; the tear line on the said first sheet having a lower tear resistance than that along the said preset tear line of each said second sheet; and a strip of adhesive material being provided on a rear face of the said portion of the form along each said side strip.

BRIEF DESCRIPTION OF THE DRAWINGS

A number of arrangements of the present invention will now be described, by way of non-limiting examples, with reference to the attached drawings in which:

FIG. 1 shows an exploded view in perspective of a computerized correspondence form according to the present invention;

FIG. 2 shows a larger-scale exploded view in perspective of part of the FIG. 1 form;

FIGS. 10 and 11 show a cross section and rear perspective view respectively of a third variation of the FIG. 1 form;

FIGS. 12 and 13 show an exploded perspective view and cross section respectively of a fourth variation of the FIG. 1 form;

DETAILED DESCRIPTION OF THE INVENTION

Figure 3:
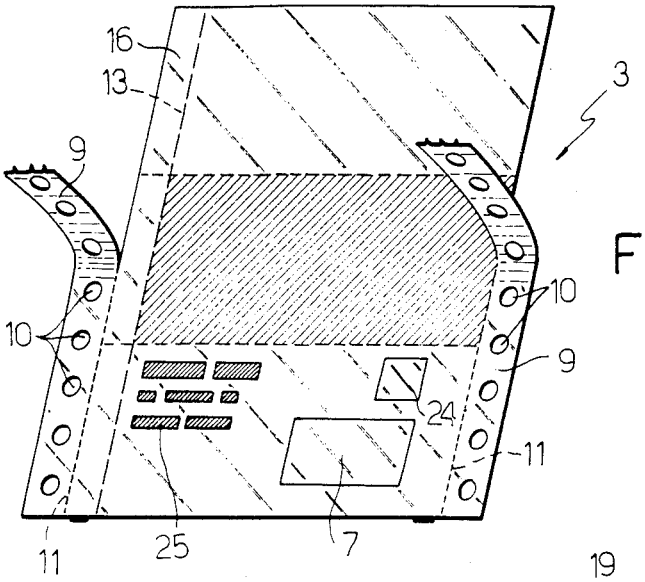
FIGS. 3, 4 and 5 show perspective views of three stages for folding and sealing the FIG. 2 form.

FIG. 1 shows a computerized correspondence form (1) comprising a front sheet (2) of normal paper, usually kept by the sender, and a letter indicated as a whole by number 3, the said letter being shown separately in FIG. 2 and comprising a front sheet (4) and two rear sheets (5), indicated 5*a* and 5*b* respectively, the second of which may be dispensed with.

Front sheet 2, hereinafter referred to as the "original sheet", usually has an area (6) in which the receiver's name and address are written. Besides being printed on original sheet 2, the receiver's name and address are also printed directly inside an area 7 on front sheet 4, the location of which matches window 6 on sheet 2, and inside areas 8 on rear sheets 5. This is made possible in that area 6 on original sheet 2 is usually covered with copy material (not shown) such as carbon powder, while each rear sheet (5) is preferably made of chemical paper.

Starting from each outer side edge, each sheet 2, 4 and 5 comprises an outer strip (9) with a number of aligned, evenly spaced punched holes (10). The two outer strips (9) are bordered inwards by preset tear lines 11 and 12 respectively for enabling strip 9 to be removed as described hereafter.

Figure 7:
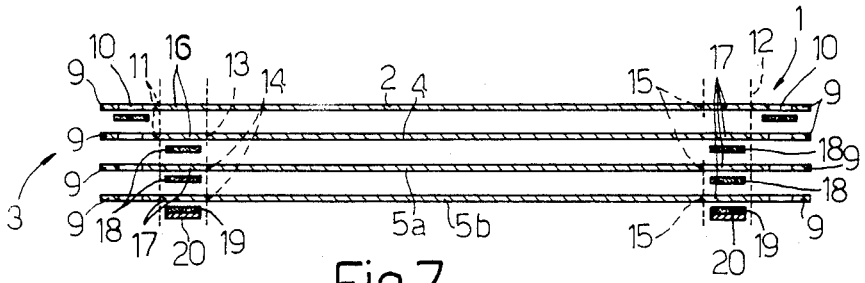
FIG. 7 shows a cross section of the FIG. 1 form.

As shown in FIGS. 1, 2 and 7, in particular, close to line 11, each sheet 4 has a further preset tear line (13) with a corresponding preset tear line (14) on each sheet 5. Tear line 14, however, does not weaken sheet 5 to the same extent as tear line 13 on sheet 4. Consequently, when subjected to strain exerted perpendicular to line 13, the resistance of sheet 4 is lower than that of each sheet 5.

Close to line 12, each sheet 5 has a further preset tear line (15) which, however, has no corresponding tear line on sheet 4.

Lines 13 and 14, on one side, and lines 15, on the other, define, on the relative sheets, side strips 16 and 17 along which each of sheets 4 and 5 is connected to the adjacent rear sheet by means of a layer (18—FIG. 7) of adhesive material. Rear sheet 5 is provided at the back, along side strips 16 and 17, with a layer (19) of adhesive material protected by removable cover strips 20 which may even be dispensed with if layer 19 is made using dry glue.

As shown, particularly in FIGS. 1 and 2, front sheet 4 is divided into three separate portions, marked 21, 22 and 23 respectively, the first of which, in addition to area 7, includes a space 24 for stamping and a space 25 for the sender's name, address and possible trade mark. Portion 23 is usually empty whereas the middle portion (22) is usually patterned to reduce transparency essentially to zero. The said pattern also prevents the message from being read if, as often happens, there is no original sheet (2) and the message is printed straight onto portion 22. Portions 21, 22 and 23 are preferably, though not necessarily, separated by dotted fold lines 26 and 27.

According to an alternative arrangement not shown, the pattern on middle portion 22 is extended to include top portion 23 and part of bottom portion 21.

The way in which form 1 is used will now be described with reference to attached drawings 3, 4, 5 and 6. On the printer (not shown) on the computer, form 1 is fed forward into the print position by wheels and pins (not shown) which engage punched holes 10. When form 1 is set in the said print position, the printer first writes a message on original sheet 2 inside a space essentially coinciding with middle portion 22 on sheet 4. The message is not reproduced on front sheet 4, but only on each of rear sheets 5 which, as already stated, are made of chemical paper or paper which in some way provides for reproduction. If the message is of more than average length, the top part of sheet 2 may also be used. In this case, the top part (23) of sheet 4 is also patterned for reducing the transparency of the said portion 23 practically to zero. The printer then writes the receiver's name and address inside area 6 and, consequently, also inside areas 7 and 8 on sheets 4 and 5. For sending letter 3, the sender first performs the operation shown in FIG. 3 which consists in removing strips 9 by tearing sheets 2, 4 and 5 along preset tear lines 11 and 12 so as to enable sheet 2 to be removed.

Figure 4:
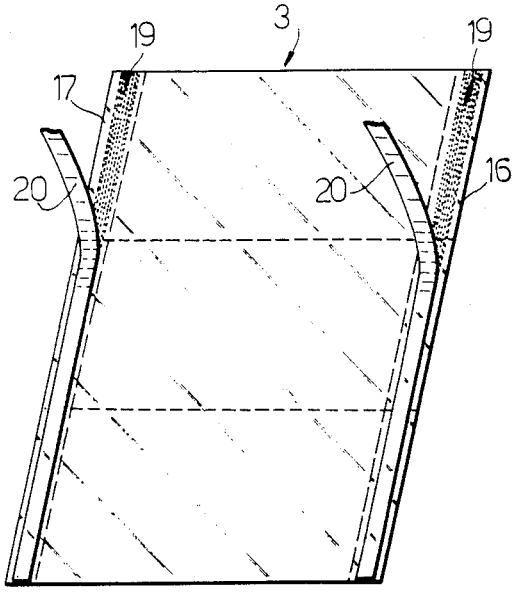
Figure 5:
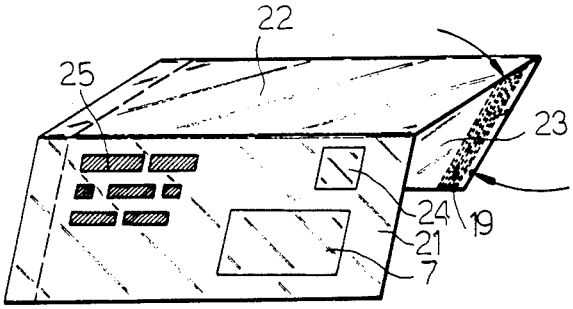

Then, as shown in FIG. 4, the sender takes strips 20 (if there are any) off the back of rear sheet 5 so as to uncover adhesive layer 19. Finally, as shown in FIG. 5, the sender folds letter 3 into three parts, first by bringing the back of top portion 23 into contact with the back of middle portion 22, so as to stick them together using adhesive layer 19, then by bringing bottom portion 21 into contact with top portion 23 and sticking the said portions 21 and 23 together using adhesive layer 19 on bottom portion 21.

The forms an envelope which is sealed perfectly along the top edge and side edges, open at the bottom and bordered, on one side, by the front face of middle portion 22, with the said pattern, and, on the other, by the front face of bottom portion 21 showing all the sender's and receiver's particulars as well as space 24 for stamping.

To open the envelope described above, the receiver takes hold of it by side strips 16 and 17 which he pulls outwards in opposite directions perpendicular to the said strips so as to tear sheet 4 along line 13 and sheets 5 along lines 15. For this purpose, lines 15 are such as to weaken sheets 5 so that the tear resistance of sheets 5 is no greater than that of sheet 4 along line 13 and is decidedly lower than the tear resistance of sheets 5 along lines 14.

Figure 6:
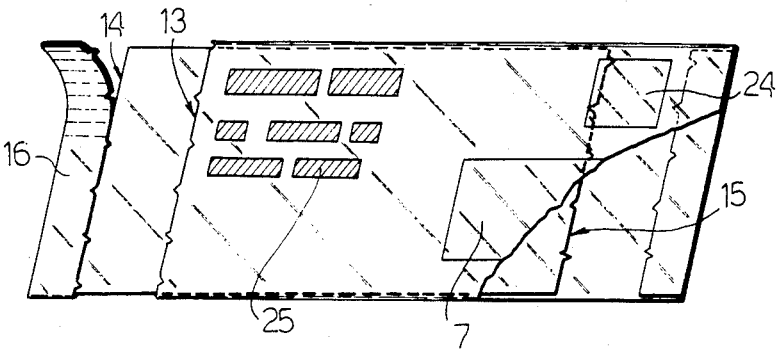
FIG. 6 shows a perspective view of the FIG. 2 form being opened.

As shown in FIG. 6, tearing sheet 4 along line 13 and sheets 5 along lines 15 enables sheets 5 and strip 16 to be pulled out of the envelope defined by folded sheet 4. Consequently, only one last operated remains to be performed by the receiver and that is to separate strip 16 from sheets 5 along line 14 so as to obtain two separate sheets 5.

Figure 8:
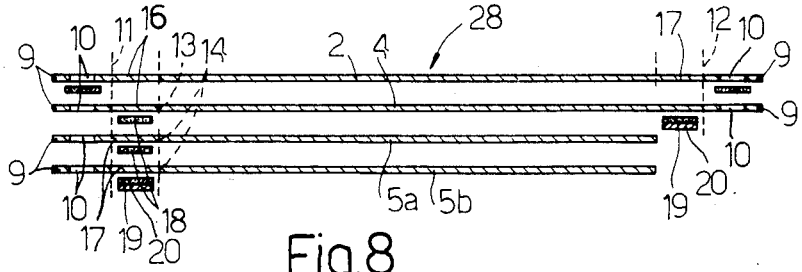
FIGS. 8 and 9 show cross sections of a first and second variation of the FIG. 1 form.
Figure 9:
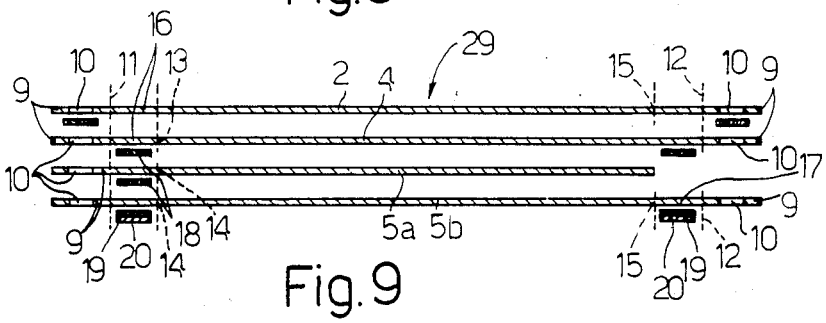

If we compare letter 3 already described with any known type of pre-enclosed form, one fact emerges clearly and that is that the former not only provides for much longer messages but also involves no manufacturing problems that cannot easily be overcome by any printing shop equipped for mass producing forms. Furthermore, letter 3 provides for considerable saving on paper in that the envelope is formed by one sheet 4 instead of two sheets stuck together as on known types of pre-enclosed forms. FIGS. 8 and 9 show two variation forms (28,29) designed for separating sheet 5 more easily from the envelope formed by sheet 4. For this purpose, sheets 5 on form 28 have none of the part outside lines 15 on form 1. Consequently, sheets 5 can be extracted from the envelope by simply tearing sheet 4 along line 13. Obviously, in this case, the missing adhesive layer (19) and strip (20) must be provided for on the back of sheet 4.

On form 29, on the other hand, only front sheet 5 is without the part outside line 15.

According to a variation not shown in the drawings, letter 3 could be longer than the one shown and consist of sheets folded into four or more parts.

The variation form (30) shown in FIGS. 10 and 11 is essentially the same as form 1 but with a few changes to rear sheet **5*b***.

As shown in FIG. 10, sheet **5*b* has a further two lines (31) inside lines 14 and 15 with which they define two strips (32). On the side facing sheet 5*a*, each of strips 32 is provided with a layer of adhesive (33) protected, if necessary, by a removable cover strip (34**).

Sheet **5*b* described above may be used as a preprinted return reply to the sender. For this purpose, the back of portion 23 may be printed with lines (35) forming, for example, a questionnaire, or it may even be left blank for a reply from the receiver to the sender. The back of portion 21, on the other hand, has areas (36, 37, 38) for the addresses of the sender and the receiver of the original letter (3**) and for a stamp or other stamping system respectively.

After separating sheet **5*b*, writing his answer on the back of portion 23 of sheet 5*b* and removing strips 34, the receiver of the original letter (3) folds sheet 5*b* the other way round along lines 26 and 27 so as to bring the front faces of portions 23 and 22 together to conceal the original letter and fold portion 21 so as to join the front face of portion 21 to the rear face of portion 23 to conceal the receiver's reply. Portions 21, 22 and 23, stuck together by adhesive layer 33, form a reply letter which can be opened by tearing sheet 5*b* along lines 31**.

Figure 12:
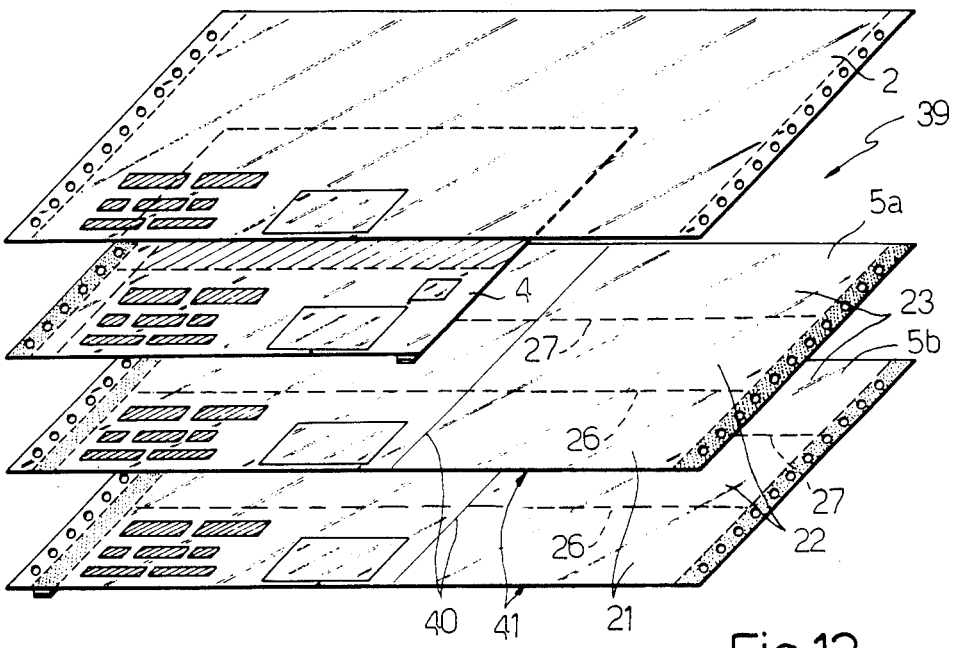
Figure 16:
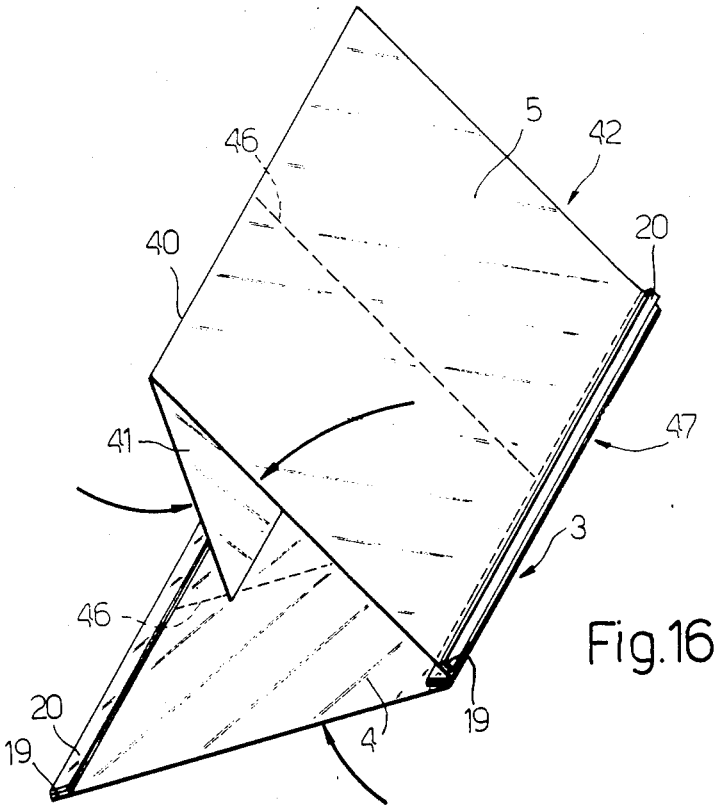
FIGS. 16 and 17 show a perspective view and cross section respectively of two successive stages for folding the FIG. 14 and 15 form.
Figure 14:
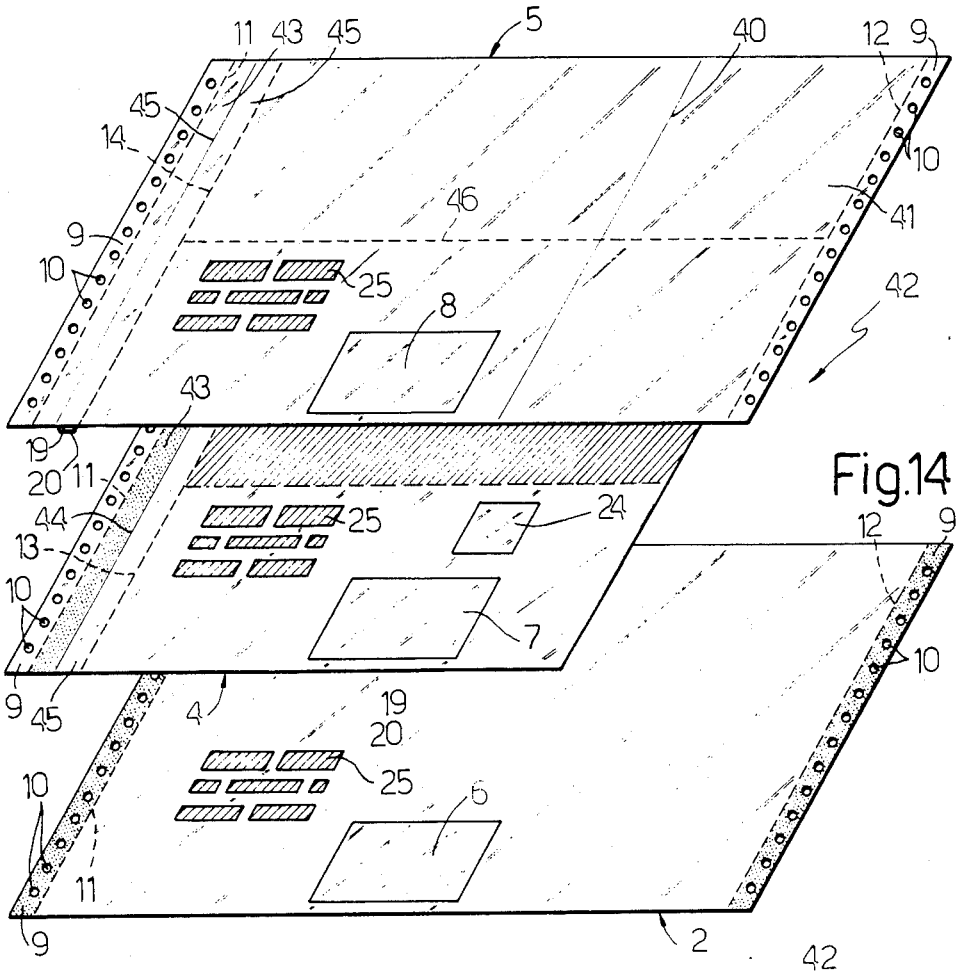
FIGS. 14 and 15 show an exploded perspective view and cross section respectively of a fifth variation of the FIG. 1 form.

The variation form (39) shown in FIGS. 12 and 13 differs from form 1 in that sheets 2 and 5 are both wider than sheet 4. Sheets 5 have a fold line (40) in the same position as line 15 on form 1 and defining a side portion (41) on sheets 5 extending laterally over the corresponding side edge of sheet 4.

After writing the message using the entire width of sheet 2 and then of sheets 5, the sender removes strips 9 to separate sheet 2 from letter 3. Subsequently, portion 40 of sheets 5 is folded underneath (or, alternatively, over) portions 21, 22 and 23 so as to return to the starting point of form 28. Obviously, as in the case of the latter, the two layers (19) and, if necessary, strips 20 are arranged, on one side, at the back of sheet 5*b* and, on the other, at the back of sheet 4.

Form 39 provides for using very wide sheets and for direct mailing of computer print-outs or other similar printed matter at the normal rate of charge in that, though the form shown (39) has a single side portion (41), nothing prevents forms (not shown) similar to form 39 from being provided with two or more portions (41) folded together along lines 40.

FIGS. 14, 15, 16 and 17 show a form (42) similar to form 39 in terms of shape before final folding and connection of the various parts to form the envelope but which is designed to enable the sender to keep the copy of the message and to send off the original. Such a procedure is necessary, for example, when sending off invoices or other accounting documents.

Figure 15:
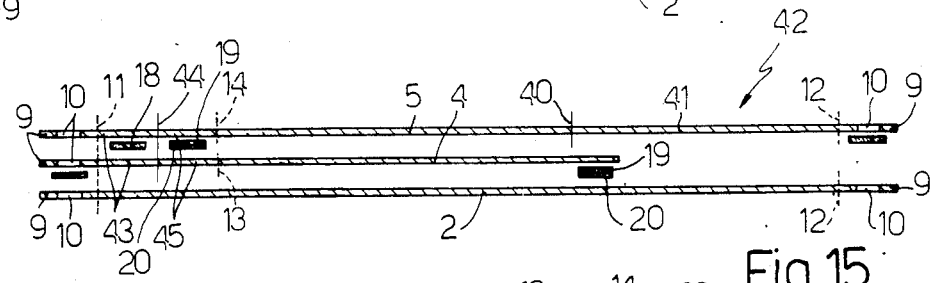
Figure 17:
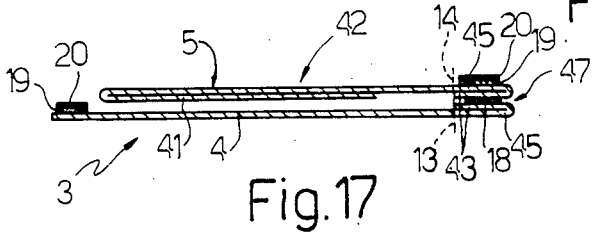
Figure 18:
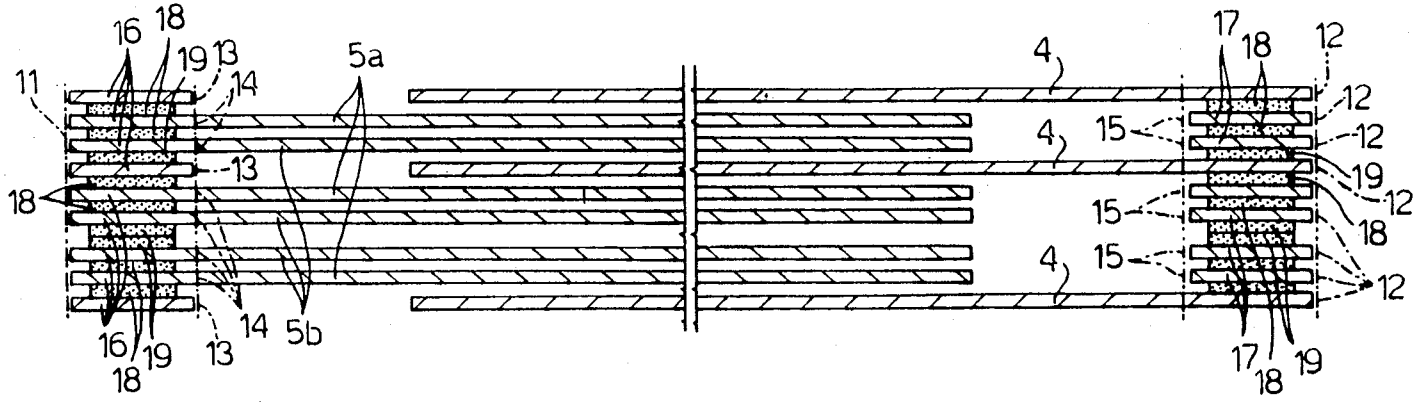
FIG. 18 is a cross-sectional view taken horizontally through FIG. 6.

As shown in FIG. 15, before being printed, form 42 is in the form of a pile of sheets comprising a front sheet (5), which is printed on directly, a rear sheet (2), which acts as a copy for the sender, and a middle sheet (4), designed to form an envelope and, together with sheets 5, to form letter 3.

Sheets 2 and 5 are wider than sheet 4 and sheet 2 is joined, at one side end, to sheet 4 and, at the other end, to sheet 5 along side strips 9, which have punched holes (10) and are bordered inwards by preset tear lines 11 and 12.

Sheet 5 is joined by a layer of adhesive material (18) to sheet 4 along a strip (43) bordered, on one side, by preset tear lines 11 on sheets 4 and 5 and, on the other, by fold lines 44 also on sheets 4 and 5. Two preset tear lines (13, 14) on sheets 4 and 5 respectively and adjacent to respective lines 44 combine with the latter to define strip 45 on each of sheets 4 and 5. Obviously, as in the case of the forms already described, line 13 on form 42 is also weaker than line 14.

Along strip 45, sheet 5 has a layer of adhesive material (19) stuck to the inside which, if necessary, may be covered by a protective strip (20). Similarly, sheet 4 also has a layer of adhesive (19) covered, if necessary, by a strip of protective material (20) and extending along the back of a side portion of sheet 4 opposite line 11.

An inner side edge of layer 19 on sheet 4 is arranged just outside fold line 40, on sheet 5, parallel to line 11 and defining side portion 41.

As in the case of the other forms already described, sheets 2, 4 and 5 on form 42 also have areas (6, 7, 8, 25) at the bottom, whereas sheet 4 also has a further area (24) for stamping.

In FIGS. 14, 15, 16 and 17, form 42 is shown, by way of an example, to be foldable in two parts along fold line 46. Obviously, however, as already stated in connection with the forms already described, form 42 may also be designed so as to be folded three or more times along crosswise fold lines. Similarly, all the forms already described may be designed so as to be folded crosswise only once as in the case of form 42 shown. What has already been stated in connection with form 39 also applies to form 42 in that one or more additional lines may be added alongside longitudinal fold line 40 so as to increase the crosswise dimension of form 42 as required. In short, both the longitudinal and crosswise dimensions of form 42 and of all the forms described previously can be varied according to the user's discretion.

Form 42 is printed in the position shown in FIG. 15, so as to print the original on sheet 5 and a copy on sheet 2, after which it is torn along tear lines 11 and 12 so as to remove side strips 19 with punch holes 10 and separate sheet 2 from letter 3.

Letter 3 is then pre-folded before being folded finally for mailing in the same way as all the other forms described previously. The said preliminary fold is shown, in particular, in FIG. 16 and consists in folding the projecting portion (41) round line 40, so as to bring it into contact with the printed front face (or, alternatively, the back face) of sheet 5, and in folding sheets 4 and 5 in opposite directions round respective lines 44, so as to obtain the arrangement shown in FIG. 17, which is identical to that of form 28 in FIG. 8 in which strips 43 and 45 of sheets 4 and 5 are overlapped to form ream 47 joined to sheets 4 and 5 along respective lines 13 and 14 and removable as already described for strip 16 on form 1. To those skilled in the art it will be clear that changes can be made to the types of form described by way of non-limiting examples without, however, departing from the scope of the present invention.

For example, each of the forms described with reference to the attached drawings could be changed very easily to prevent the envelope formed by it from being left open along a side edge.

With reference, for example, to the arrangement shown in FIGS. 1 to 7, the said change would consist in designing sheets 2, 4 and 5 so that they could be folded, not into three but into four parts, three of which essentially equal and the fourth, at the end, shorter.

With reference, for example, to FIG. 5, form 1 could be changed by transferring spaces 24, 25 and 7 on to portion 23, by lengthening the said portion 23 so as to form the said fourth shorter end portion (not shown) and by folding, firstly, portion 21 to contact the back of portion 22, then portion 23 to contact the front of portion 21 and, finally, the said fourth end portion (not shown) to contact part of the front of portion 22. In this way, an envelope would be formed which, as requested by certain postal authorities, is closed along its longer edges.

I claim:

1. A computerized correspondence form, at least one portion of which is designated to be folded so as to form an envelope containing at least one sheet, said portion of the form comprising a first sheet and at least one second sheet; said first sheet and each said second sheet including a first side edge, a second side edge parallel to said first side edge, a front face and a rear face, the front face of said first sheet and the rear face of one said second sheet constituting a front face and a rear face of said portion of the form, respectively, each said sheet including a first and second side strip extending close to, and parallel with, said first and said second side edges, respectively, of the respective one of each said sheet; said sheets being joined to each other at at least said first strips, each said strip having an outer edge facing the respective side edge, and an inner edge facing away from the respective side edge, a preset tear line weakening each said sheet along the inner side edge of the respective first strip, said preset tear line on said first sheet having a lower tear resistance than said preset tear line of each said second sheet, and a strip of adhesive material being provided on said rear face of said portion of the form along each said side strip of said one second sheet.

2. A form as claimed in claim 1, wherein said sheets have substantially the same width in a direction perpendicular to said strips, joining means being provided along each said strip to join each sheet to each adjacent sheet, at least one second sheet having, along the inner edge of the respective second strip thereof, a preset tear line which provides for greater weakening than the preset tear line extending along the inner edge of said first strip.

3. A form as claimed in claim 1, wherein one said second sheet is smaller in width, taken in a direction perpendicular to said strips, than said first sheet, and is at most equal in width to said first sheet less said second strip thereof.

4. A form as claimed in claim 3, wherein said one smaller second sheet is provided with a side edge adjacent to the respective second strip and includes a longitudinal fold line extending parallel to said second strip, a side portion folded at least once and overlapping said smaller second sheet being joined to said smaller second sheet along said longitudinal fold line.

5. A form as claimed in claim 1, comprising a further sheet joined to said portion of the form along two side strips extending outside said first and second strips and having holes for feeding the form forward during printing.

6. A form as claimed in claim 5, wherein said further sheet is arranged facing the rear race of said first sheet.

7. A form as claimed in claim 5, wherein said further sheet is arranged facing the front face of said first sheet.

8. A form as claimed in claim 1, wherein one said second sheet is provided, on its front face, with two further strips of adhesive material arranged adjacent to and inside said first and said second side strips, respectively.

9. A form as claimed in claim 1, wherein each said first strip comprises a pair of overlapping strips folded over each other along a fold line, one strip of said pair of strips of said first sheet being joined to a corresponding strip of said pair of strips of a second sheet, and the other strip of each said pair of strips being joined to the respective first and second sheet along the respective preset tear line.

10. A form as claimed in claim 1, wherein said portion of the form is provided with at least one fold line extending transversely of said strips.

11. A form as claimed in claim 1, wherein said portion of the form is provided with at least two fold lines extending transversely of said strips.

* * * * *